US012588723B2

(12) United States Patent
Deloach

(10) Patent No.: US 12,588,723 B2
(45) Date of Patent: Mar. 31, 2026

(54) FACE MASK DEVICE

(71) Applicant: Veronica Deloach, Antioch, CA (US)

(72) Inventor: Veronica Deloach, Antioch, CA (US)

( * ) Notice: Subject to any disclaimer, the term of this patent is extended or adjusted under 35 U.S.C. 154(b) by 531 days.

(21) Appl. No.: 17/500,764

(22) Filed: Oct. 13, 2021

(65) Prior Publication Data

US 2023/0111665 A1 Apr. 13, 2023

(51) Int. Cl.

*A41D 31/10* (2019.01)
*A41D 13/11* (2006.01)
*A41D 27/08* (2006.01)

(52) U.S. Cl.

CPC ..... *A41D 31/10* (2019.02); *A41D 13/1115* (2013.01); *A41D 27/08* (2013.01)

(58) Field of Classification Search

CPC ..... A41D 13/00; A41D 13/05; A41D 13/11; A41D 13/1115; A41D 13/1161; A41D 31/10; A41D 31/102; A41D 27/08; A62B 18/00; A62B 18/02; A62B 23/025; A61M 16/0087; A61M 16/009; A61M 16/0093; A61M 16/0605; A61M 16/06; A61M 16/047; A61M 16/0683

USPC ..... 128/206.12, 206.13, 206.16, 206.19, 128/206.21, 863, 866, 200.24, 206.28, 128/207.11

See application file for complete search history.

(56) References Cited

U.S. PATENT DOCUMENTS 2,161,607 A * 6/1939 Anderson ..... A62B 23/06 128/206.18
5,727,544 A * 3/1998 Miura ..... A41D 13/11 128/206.16
11,617,402 B2 * 4/2023 Mallady, Jr. ..... A41D 13/1107 128/206.19
2009/0044812 A1 * 2/2009 Welchel ..... A41D 13/1161 128/207.11

FOREIGN PATENT DOCUMENTS

DE 102016124196 A1 * 3/2018 ..... A41D 13/113
DE 202020101979 * 5/2020
DE 202020101979 U1 * 5/2020

OTHER PUBLICATIONS

Machine translation of DE202020101979U1 (Year: 2020).*
Machine translation DE102016124196A1 (Year: 2018).*

* cited by examiner

*Primary Examiner* — Caitlin A Carreiro
(74) *Attorney, Agent, or Firm* — William Gray Mitchell

(57) ABSTRACT

A face mask device utilizing a sheet of fluid penetration resistant material that includes first and second edge portions that are foldable against one another. Such folding creates a compact face mask that only covers the nose of the user and is employable during medical visits and also facilitates eating in public settings.

2 Claims, 2 Drawing Sheets

FACE MASK DEVICE

CROSS-REFERENCES TO RELATED APPLICATIONS

The present application claims the benefit of U.S. Provisional Application 63/259,928, filed 23 Aug. 2021.

BACKGROUND OF THE INVENTION

The present application relates to a novel and useful face mask device.

In the past, face masks have been worn by hospital and medical center staff to prevent the spread of disease. This practice has taken place over a long period of time in the past. It is believed that the wearing of a face mask will prevent the spread of infection and prevent the individual from contracting airborne infectious germs. In other words, when a person coughs, talks, sneezes, and the like, they could release germs or microbes into the air that may infect others nearby. Thus face masks have become part of an infection control strategy to eliminate cross-contamination, which is especially important during a viral pandemic.

However, the use of face masks in certain settings is impractical. For example, eating in a public restaurant, visiting a physician or dental practitioner, and the like, entails the removal of face masks.

In the past, face masks have been rated as to the ability to serve as a barrier to certain fluids such as blood, aerosols, and the like. Level 1 masks are considered to be a low barrier. Level 2 masks provide a higher level of protection, while level 3 masks are considered to be a high barrier. However, in any case, face masks generally cover the nose and mouth of the user and, again, must be removed to engage in certain activities.

A face mask device which allows general protection and is also able to be employed during activities such as medical treatment, eating, and the like, would be a notable advance in the medical field.

SUMMARY OF THE INVENTION

In accordance with the present application, a novel and useful face mask device is herein provided.

The face mask device of the present application includes a sheet of fluid penetration resistant material having first and second edge portions. A strip of flexible metallic material is enclosed in soft pressure absorbing material, such as polymeric foam, at one of the edges. The sheet of fluid penetration resistant material would be sized to extend over the nose and mouth of the user when in use. However, the sheet of fluid penetration resistant material includes a foldable portion to allow one of the edge portions to extend or rotate upwardly and connect to the other edge portion to form a face mask which only covers the nose of the user. In this case, the mouth of the user is available for treatment by dental practitioner, eating, and the like, while preventing effluents from the user's nose and microbial influx to the user's nose. When such activities have ceased, the face mask device may again assume its original configuration to cover both the nose and the mouth by releasing the fastener and allowing the second edge portion to extend downwardly again over the mouth of the user. In certain cases, the mask configuration covering only the user's nose may be permanent.

A fastenable tie is connected to the sheet of fluid penetration resistant material and may be employed to engage the ears of the user or extend to the back of the head of the user to hold the mask in place.

It may be apparent that a novel and useful face mask device has been hereinabove described.

It is therefore an object of the present application to provide a face mask device which is capable of covering the nose and mouth of the user and yet is convertible to a mask which only covers the nose of the user.

Another object of the present application is to provide a face mask device which is convertible into various orientations to cover nose and mouth of a person when necessary.

Another object of the present application is to provide a face mask device which is capable of providing ASTM level 3 resistance.

A further object of the present application is to provide a face mask device which includes a sheet of fluid penetration resistant material that is foldable and includes a first and second edge portion such that the second edge portion may be placed adjacent first edge portion and fastened thereto.

Another object of the present application is to provide a face mask device which is sized to only cover the nose of the user, leaving the mouth of the user free of the mask.

Another object of the present application is to provide a face mask device which includes a fastenable tie which may be used either to hold the mask to the ears of the user or about the head of the user, and can also be operated with surgical tape to further secure the mask below the nose and above the lip of the user.

Another object of the present application is to provide a face mask device that may be used with protective eyewear such as goggles or eyeglasses.

Another object of the present application is to provide a face mask device which is suitable for use in a medical facility, such as a dental office, and allows the medical practitioner to perform medical procedures.

The application possesses other objects and advantages especially as concerns particular characteristics and features thereof which will become apparent as the specification continues.

For a better understanding, reference is made to the following detailed description of the preferred embodiments which should be referenced to the prior described drawings.

DETAILED DESCRIPTION OF THE PREFERRED EMBODIMENTS

Various aspects of the present application will evolve from the following detailed description of the preferred embodiments thereof which should be referenced to the prior delineated drawings.

Figure 1:
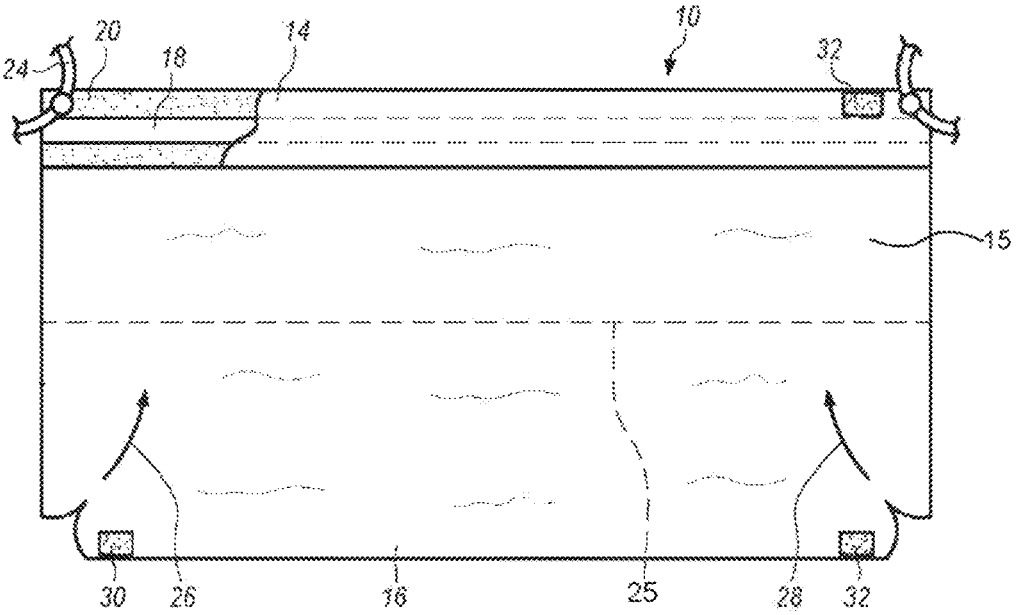
FIG. 1 is a rear elevational view of the face mask of the present application.

The application as a whole is depicted in the drawings by reference character 10. With reference to FIG. 1, face mask 10 includes as one of its elements a sheet of fluid penetration resistant material 12. Sheet 12 may be formed of any suitable fluid filtering material, such as polypropylene and the like. In essence, the material, along with the structure hereinafter described, would be suitable to create a face mask that is rated as an ASTM level 3 surgical mask. Again referencing FIG. 1, sheet 12 is formed with a first edge portion 14 and a second edge portion 16. First edge portion 14 also includes an ensheathed metallic strip 18 surrounded by a soft pressure absorbing material 20, such as polymeric foam. Metal strip 18 and foam portion 20 are in the form of a strip 22 that extends along first edge portion 14.

Sheet 12 also includes a pair of fastenable ties 24 and 26 which may be employed to hold face mask 10 to the user's ears or about the head, respectively. Ties 24 and 26 may be in the form of a flat elastic band when extending about the head of the user. Sheet 12 may be folded along fold line 25, according to directional arrows 26 and 28, FIGS. 1-3. Fasteners 30 and 32 are depicted in the form of hook and pile pairs. It should be realized that the image of fastener 30 is not shown on FIG. 1 for the sake of clarity. Thus, fasteners 30 and 32 are removable fasteners which allow the connection and disconnection of second edge portion 16 to first edge portion 14 of sheet 12.

Figure 2:
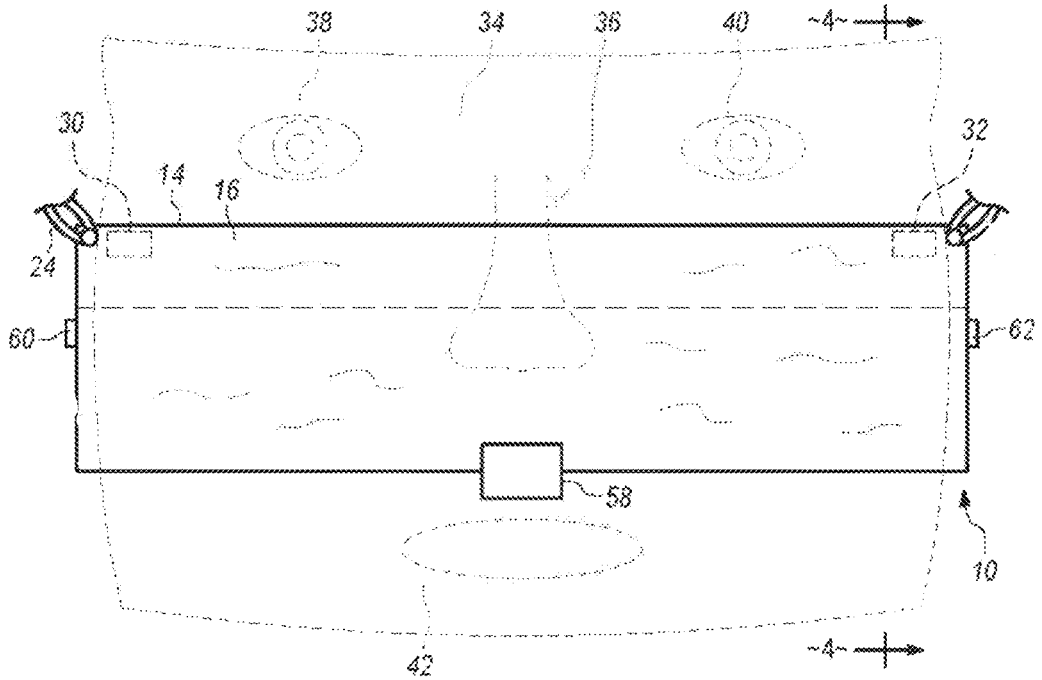
FIG. 2 is a front plan view of the face mask of the present application where a section of the face mask material has been folded against itself.

Viewing FIG. 2, it may be observed that face mask 10 has been rotated from the orientation of FIG. 1 into a view of the front portion of the same where first edge portion 14 and second edge portion 16 have been placed adjacent one another. Also, first fastener 30 and second fastener 32 are shown in their removable mated configuration. Face mask 10 has also been placed over a user's face 34 such that face mask 10 only covers the nose 36 of the user. The eyes 38 and 40 of the user are not being obscured by face mask 10, while mouth 42 is also free of face mask 10. It should be noted that the nose 36, eyes 38 and 40, and mouth 42 of the user have been depicted in phantom in FIG. 2.

Figure 3:
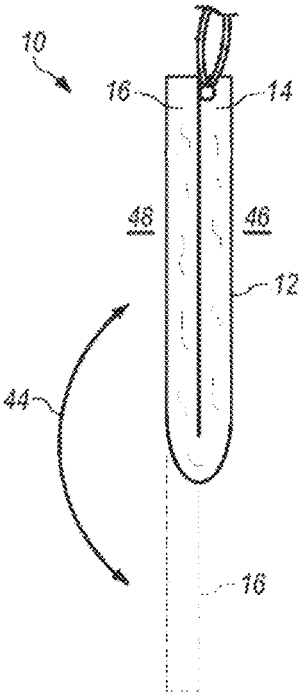
FIG. 3 is a side-elevational view of the face mask of the present application showing its folding operation.
Figure 4:
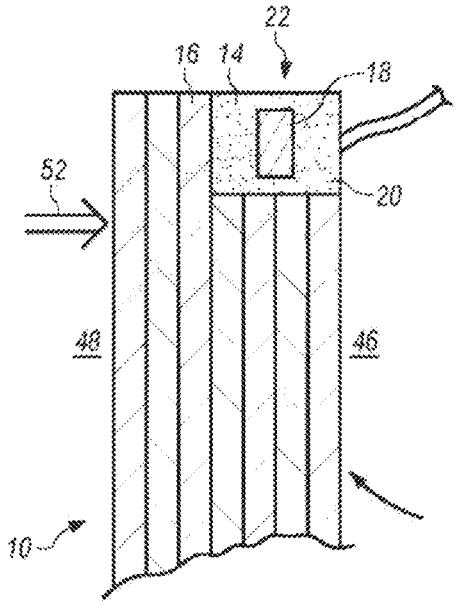
FIG. 4 is a partial enlarged partial sectional view taken along line 4-4 of FIG. 2.

With reference to FIG. 3, the folding of sheet 12 is illustrated such that second edge portion 16 lies against first edge portion 14 to form the compact configuration shown in FIG. 2. FIG. 2 also indicates that such folding action defines front 46 of face mask 10 as well as the rear 48 of face mask 10. As heretofore explained, the rear 48 of face mask 10 lies adjacent the face 34 of the user depicted in FIG. 2. FIG. 4 represents an enlargement of the folded face mask shown in FIG. 3 in which it may apparent that an octet of plies 50 lie against one another when face mask 10 is in its folded position. This large number of plies is capable of providing protection to the extent of an ASTM level 3 surgical mask. Directional arrow 52 illustrates the force of the face 34 of the user against the mask which is relatively remote from the ensheathed metal strip 18 which is normally pressed against the nose 16 of the user when mask 10 is worn.

Figure 5:
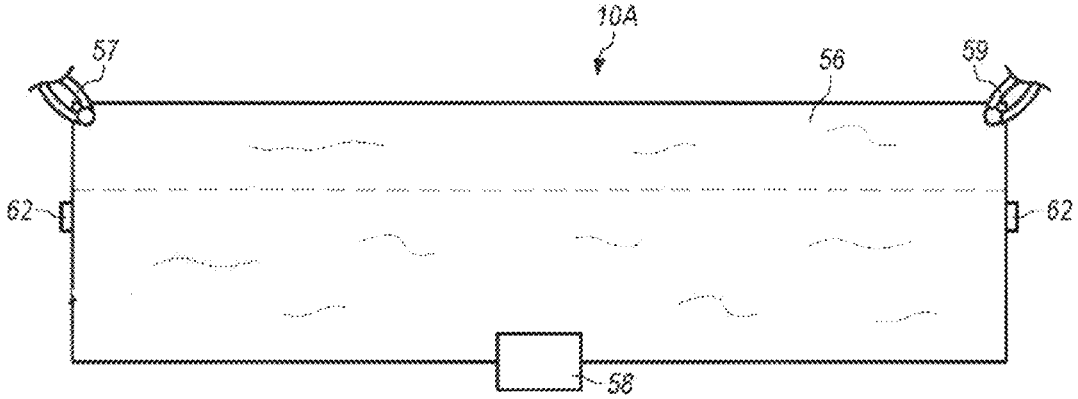
FIG. 5 is a rear elevational view of another embodiment of the face mask of the present application.

FIG. 5 shows another embodiment 10A in which a sheet of the fluid penetration resistant material 56 has been pre-formed into an 8 layer body such as that shown in FIG. 4. Fastenable ties 57 and 59 are also depicted and may be used to engage the ears of the user or to extend around the back of the head of the user when mask 10A is in place. Also, surgical tape pieces 58, 60, and 62 may augment the further securement of mask 10A to the face of the user. In addition, other self-adhesive tapes may be employed in this regard. It should be noted that such surgical tape pieces may also be used with mask 10, shown in FIGS. 1 and 2.

In operation, the user employs face mask 10 by folding over edge portion 16 against edge portion 14 to create the compact configuration of face mask 10 shown in FIG. 2. Fasteners 30 and 32 may be employed to removably hold face mask 10 in this configuration. It should be noted that other fasteners, such as staples, clips, and the like may be employed in this regard to achieve a more permanent state. Once in the configuration shown in FIG. 2, face mask 10 is placed over the face 34 of the user to cover the nose 36 of the user while leaving eyes 38 and 40, as well as mouth 42, free of mask 10. In this configuration, the user is free to subject itself to medical or dental procedures, eat, and the like. After such activities, the face mask 10 may be again folded downwardly into the configuration found in FIG. 1. With respect to the embodiment 10A depicted in FIG. 5, face mask 10A may be formed into a size similar to that shown in FIG. 2 without the ability to fold upwardly and downwardly as described hereinbefore. Face mask 10A, however, may be used in the same manner as face mask 10 in its folded compact condition depicted in FIG. 2.

While in the foregoing, embodiments of the application have been set forth in considerable detail for the purposes of making a complete disclosure of the application, it may be apparent to those of skill in the art that numerous changes may be made in such details without departing from the spirit and principles of the application.

I claim:

1. A face mask device intended for selectively covering the nose and mouth of a user, having an outside and an inside, comprising:

a sheet of fluid penetration resistant material comprising a single fold line dividing the sheet into two parts, said sheet including a first edge portion, a completely separated second edge portion, a left edge and a right edge;

a strip of flexible metal enclosed in soft pressure absorbing material, said strip extending along said first edge portion of said sheet;

a pair of fastenable ties, each with a single point of attachment near an upper corner of the sheet of fluid penetration resistant material, for securing around ears or behind a head of a wearer;

two fasteners, embodied as hook and pile pairs, for removably holding said second edge portion of said sheet of fluid penetration resistant material against said first edge portion of said sheet when said sheet is folded over along the fold line such that the mask comprises a double layer configured for covering only the nose when the sheet is folded, wherein said second edge portion of said sheet forms a portion of the outside of the face mask, device and said first edge portion forms a portion of the inside of the face mask device intended to only cover the nose of the user on the face of the user, said sheet of fluid penetration resistant material further being configured to cover the nose and mouth of the user upon disconnection of said two fasteners for completely separating said first edge portion from said second edge portion of said sheet of fluid penetration resistant material such that the mask comprises a single layer configured for covering the mouth and nose when said sheet is unfolded; and three tape pieces for securing the mask to a face of the user, wherein a first tape piece is arranged on the left edge, a second tape piece is arranged on the right edge and a third tape piece is arranged at a center point on the fold line such that when said sheet is folded over along the fold line, the third tape piece is configured to secure the mask to the face of the user in the area between the nose and mouth.

2. The face mask device of claim 1 in which said sheet of fluid penetration resistant material comprises poly-propylene.

* * * * *